United States Patent [19]

Molnar

[11] 4,167,055

[45] Sep. 11, 1979

[54] SLIDE FASTENER WITH CROSS ORIENTED POLYMER TAPES

[75] Inventor: Frank J. Molnar, Meadville, Pa.

[73] Assignee: Textron Inc., Providence, R.I.

[21] Appl. No.: 845,467

[22] Filed: Oct. 25, 1977

Related U.S. Application Data

[63] Continuation-in-part of Ser. No. 754,943, Dec. 28, 1976, abandoned.

[51] Int. Cl.[2] ..... A44B 19/34

[52] U.S. Cl. ..... 24/205.16 C; 24/205.1 C; 112/441; 428/52; 156/93

[58] Field of Search ..... 24/205.16 C, 205.1 R; 112/441; 428/52; 156/93

[56] References Cited

U.S. PATENT DOCUMENTS 4,045,846 9/1977 Moertel ..... 24/205.16 C

FOREIGN PATENT DOCUMENTS 1437179 5/1976 United Kingdom ..... 156/93

*Primary Examiner*—Bernard A. Gelak
*Attorney, Agent, or Firm*—O'Brien & Marks

[57] ABSTRACT

Each of the carrier tapes of a slide fastener include respective pairs of superimposed layers or plies of highly oriented polymer through which stitching threads are secured to attach coupling elements to each tape. The molecular orientation of each of the superimposed layers is at an oblique angle to the inner edge of the tapes with the orientation of one layer being transverse to the orientation of the other layer to prevent tearing of the stitches from the tapes.

40 Claims, 54 Drawing Figures

FIG. 26
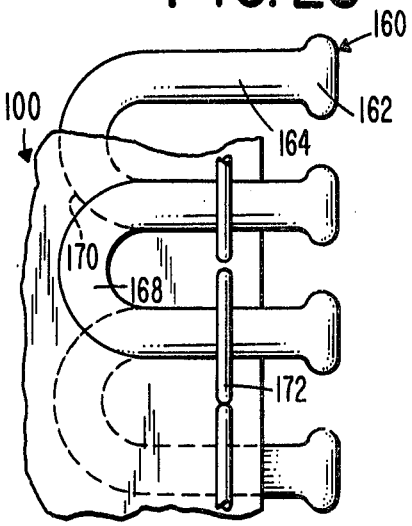
FIG. 27
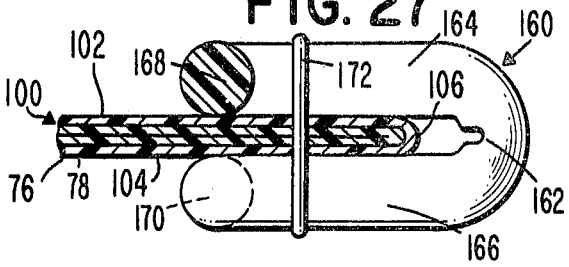
FIG. 28
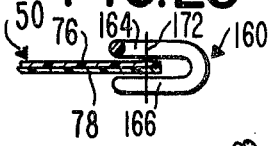
FIG. 29
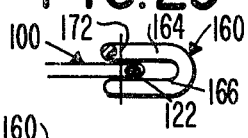
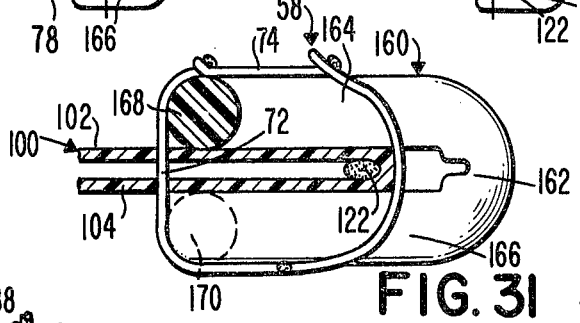
FIG. 31
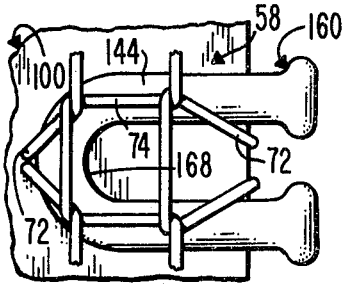
FIG. 30
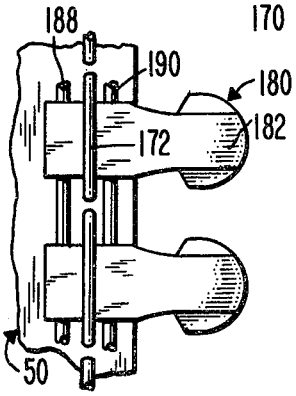
FIG. 32
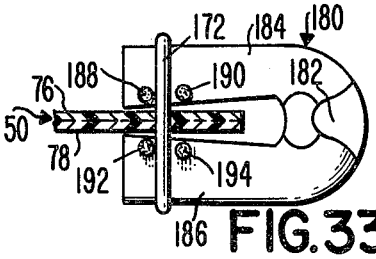
FIG. 33
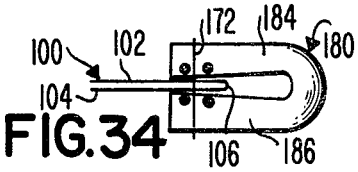
FIG. 34
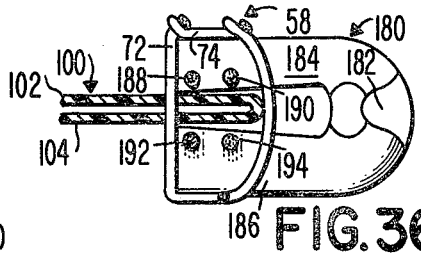
FIG. 36
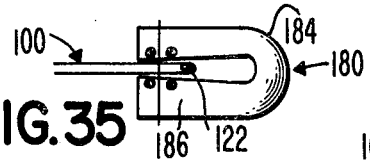
FIG. 35
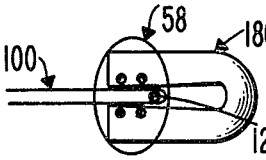
FIG. 37
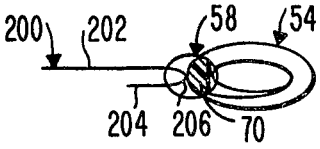
FIG. 38
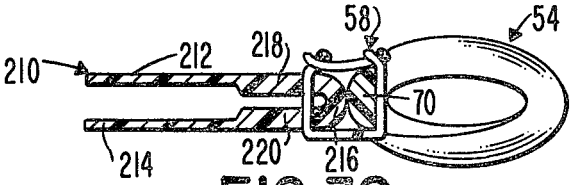
FIG. 39

SLIDE FASTENER WITH CROSS ORIENTED POLYMER TAPES

CROSS-REFERENCE TO RELATED APPLICATION

This application is a continuation-in-part application of U.S. application Ser. No. 754,943 filed Dec. 28, 1976 which is now abandoned and incorporated herein by reference.

BACKGROUND OF THE INVENTION

1. Field of the Invention

This invention relates to slide fasteners and particularly to slide fasteners employing synthetic polymer resin tapes.

2. Description of the Prior Art

The prior art, as illustrated in U.S. Pat. No. RE 26,086, No. 3,414,948, No. 3,474,505, No. 3,579,748, No. 3,789,465 and No. 3,831,228, contains a number of slide fasteners wherein continuous coupling elements are sewn to the inner edges of a pair of tapes; such tapes generally being woven textile fabrics. Despite the cost advantage of synthetic polymer or plastic film tapes over woven textile tapes, attempts to utilize such plastic tapes in place of the woven tapes have been unsuccesful since the stitching readily tears from the plastic material.

SUMMARY OF THE INVENTION

The invention is summarized in a stringer for a slide fastener including a continuous coupling element having a plurality of head portions for interlocking with head portions of a mating coupling element, a carrier tape, stitching means securing the continuous coupling element to one edge of the carrier tape, the tape including a pair of superimposed portions through which the stitching means passes, each of the pair of superimposed portions being a highly oriented polymer film, and the polymer orientations of the pair of superimposed portions being transverse to each other.

An object of the invention is to construct a reliable low cost slide fastener.

Another object of the invention is to substitute a low cost polymer tape for textile tapes employed in fasteners wherein the coupling elements are sewn or stitched to the tapes.

It is also an object of the invention to provide a slide fastener construction employing coupling elements sewn to a polymer tape wherein the stitching does not readily pull from the polymer tape.

An advantage of the invention is that a polymer tape having at least two layers or plies with molecular orientations transverse relative to each other and oblique to the edge of the tape to which coupling elements are stitched results in a slide fastener which is more economical but yet sufficiently strong to withstand considerable stress.

In one feature of the invention the stitching means passes through the folded edge of a tape which has a molecular orientation oblique to the longitudinal dimension of the tape so that in each folded half of the tape the orientation is transverse to the opposite half.

Another feature of the invention provides for one or more longitudinal cords also secured by the stitching means.

Other objects, advantages and features of the invention will be apparent from the following description of the preferred embodiments taken in conjunction with the accompanying drawings.

BRIEF DESCRIPTION OF THE DRAWINGS

FIG. 26 is an enlarged plan view of a stringer portion of still another modified version with a meander ladder coupling element of the slide fastener in accordance with the invention.

FIG. 27 is a cross section view of the slide fastener stringer portion of FIG. 26.

FIG. 28 is a diagrammatical cross section view of a variation of the stringer portion of FIGS. 26 and 27.

FIG. 29 is a diagrammatical cross section view of a second variation of the stringer portion of FIGS. 26 and 27.

FIG. 30 is an enlarged plan view of a portion of a stringer of a third variation of the stringer portion of FIGS. 26 and 27.

FIG. 31 is a cross section view of the stringer portion variation of FIG. 30.

FIG. 32 is an enlarged plan view of a portion of a stringer of a further modification with a molded train of coupling elements in the slide fastener in accordance with the invention.

FIG. 33 is a cross section view of the stringer portion of FIG. 32.

FIG. 34 is a diagrammatical cross section view of a variation of the modified stringer portion of FIG. 33.

FIG. 35 is a diagrammatical cross section view of a second variation of the modified stringer portion of FIG. 33.

FIG. 36 is a cross section view similar of FIG. 33 of a third variation of the slide fastener stringer portion of FIG. 33.

FIG. 37 is a diagrammatical cross section view of a fourth variation of the stringer portion of FIG. 33.

FIG. 38 is a diagrammatical cross section view of a portion of a stringer of a still further modification with a narrow folded tape flap of the slide fastener in accordance with the invention.

FIG. 39 is a cross section view of a stringer portion of yet another modification with thickened folded tape portions of the slide fastener in accordance with the invention.

DESCRIPTION OF THE PREFERRED EMBODIMENTS

Figure 1:
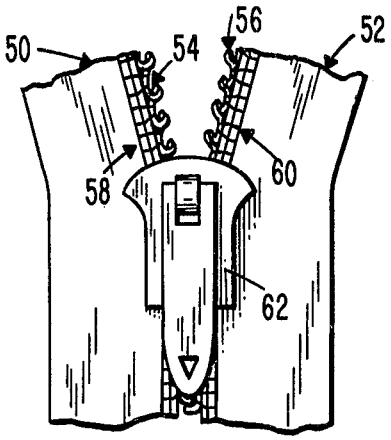
FIG. 1 is a plan view of a slide fastener constructed in accordance with the invention.

As illustrated in FIG. 1, the invention is embodied in a slide fastener having carrier tapes indicated generally at 50 and 52 and having continuous coupling elements indicated generally at 54 and 56 which are secured to the inner edges of the respective supporting members or tapes 50 and 52 by respective stitching means indicated generally at 58 and 60. A slider 62 is slidably mounted on the continuous coupling elements 54 and 56 for opening and closing the slide fastener. The support member 50 and coupling element 54, as viewed in FIG. 1, form a left stringer while the support member 52 and the coupling element 56 form a right stringer; the right stringer is substantially the mirror image of the left stringer and only the left stringer is described in detail.

Figure 2:
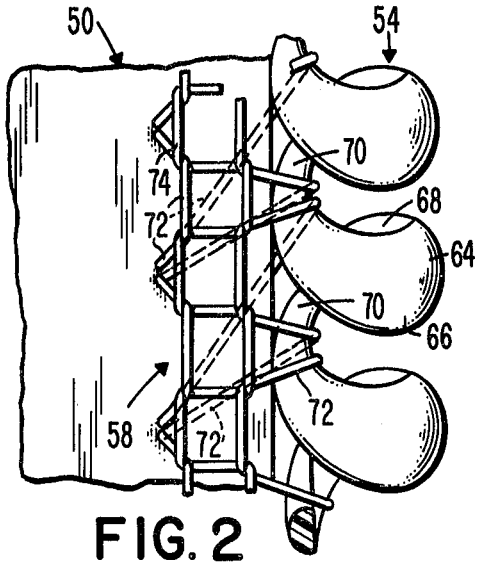
FIG. 2 is an enlarged plan view of a portion of one stringer of the slide fastener of FIG. 1.
Figure 3:
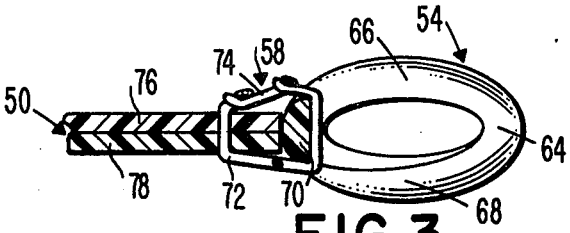
FIG. 3 is a cross section view of the stringer portion of FIG. 2.
Figure 4:
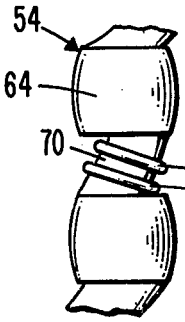
FIG. 4 is a side view of the stringer portion shown in FIGS. 2 and 3.

The coupling element 54, as shown in FIGS. 2, 3 and 4, is formed from a continuous filament such as a nylon or polyester filament which has a oblong cross section, such as a D-shaped cross section, and which is formed into a spiral with successive convolutions or sections. Each convolution of the coupling element 54 includes a head portion 64, an upper leg portion 66 extending from the upper side of the head portion 64, a lower leg portion 68 extending from the lower side of the head portion 64, and a connecting or heel portion 70 interconnecting the lower leg portion 68 to the upper leg portion of an adjoining convolution.

The stitching means 58 includes a pair of threads 72 and 74 stitched together in a conventional overedge stitch wherein the thread 72 passes through the support member 50 and around the interconnecting portions 70 of the coupling element 54 to secure the interconnecting portions 70 in abutting relationship against the inner edge of the tape 50. It is noted that the particular overedge stitch is selected with respect to the direction of the spiral of the coupling element 54 so that the thread 72 passes over the interconnecting portion 70 in a direction generally perpendicular to the interconnecting portion 70 and oblique to the plane of the tape 50.

Figure 5:
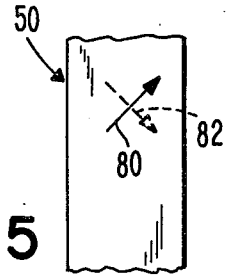
FIG. 5 is a plan view of a portion of a tape forming a support member of the slide fastener stringer of FIGS. 2 and 3.

The tape 50 includes two plies or layers 76 and 78 laminated together and through which the thread 72 passes; additional laminated layers could be included. Each of the layers 76 and 78 is a film formed from a polymer material such as high density polyethylene or similar polymer with a high degree of molecular orientation; in FIG. 5, the molecular orientation of the top layer 76 is shown by the arrow 80 while the molecular orientation of the bottom layer 78 is shown by the phantom arrow 82. Both molecular orientations 80 and 82 of the layers 76 and 78 are at an oblique angle to the longitudinal dimension or the edges of the tape 50. The molecular orientation 80 of the top layer 76 is transverse with or crosses the molecular orientation 82 of the bottom layer 78. One suitable laminated film with crossing orientations is available from Van Leer Plastics Inc. under the trademark VALERON.

The tape 50 with two or more highly oriented polymer layers wherein the orientations are transverse to each other and oblique to the inner edge of the tape makes possible a reliable slide fastener utilizing a low cost polymer film in place of the conventional textile tapes. Although oriented polymer film materials have great strength and stability against stress applied in the direction parallel the orientation, they have relatively little resistance to tearing along a line parallel to the orientation or to stress applied in a direction perpendicular to the direction of the orientation. The thread 72 inserted through the layers 76 and 78, when subject to a force transverse to the longitudinal dimension of the tape 50 tends to split the layer 76 along a line in the direction of the arrow 80 and to split the layer 78 along a line in the direction of the arrow 82. However, the layer 76 will resist splitting or tearing along a line transverse to the arrow 80 and the layer 78 will resist splitting or tearing along a line transverse to the arrow 82; thus with the two layers 76 and 78 superimposed, the thread 72 cannot readily be pulled along either of the crossing directions of the arrows 80 and 82 and the stitching 58 is securely held in the edge of the tape 50 to attach the coupling element 54 to the support member 50. This enables the manufacture of a slide fastener with reduced cost due to the employment of lower polymer film tapes in place of conventional textile tapes wherein the stitching means is used to secure the continuous coupling elements to the inner edges of the tapes.

Figure 6:
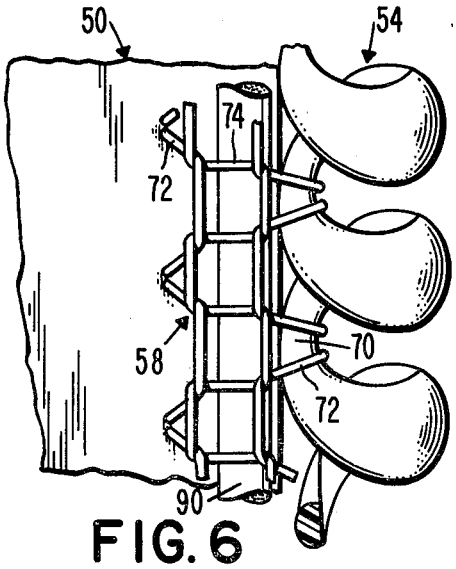
FIG. 6 is enlarged plan view similar to FIG. 2 of a variation of the slide fastener stringer.
Figure 7:
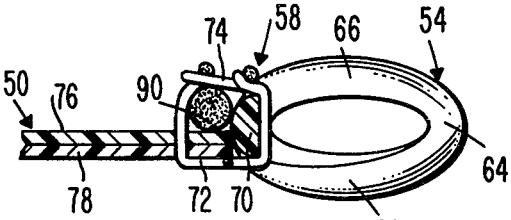
FIG. 7 is a cross section view of the stringer portion shown in FIG. 6.
Figure 8:
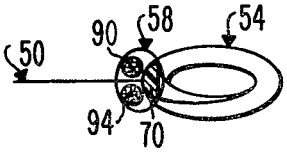
FIG. 8 is a diagrammatical cross section view of another variation of the slide fastener stringer.

In a variation shown in FIGS. 6 and 7, an external cord 90 of textile or the like extending longitudinally over the inner edge of the tape 50 and in abutting relationship to the heels 70 of the coupling element 54 is also secured by the overedge stitching 58. The threads 72 and 74 of the stitching 58 surround the cord 90 along with the heel portion 70. In another variation illustrated in FIG. 8, a second longitudinal core 94 is secured below the tape 50 of the coupling element by the stitching 58. The cord 90 of the variation of FIGS. 6 and 7 and the cords 90 and 94 of the variation of FIG. 8 provide a textile bead on the heels of the coupling element 54 against which the slider flanges engage during opening and closing of the slide fastener; the textile bead distributes stress and results in easier operation of the slider.

Figure 9:
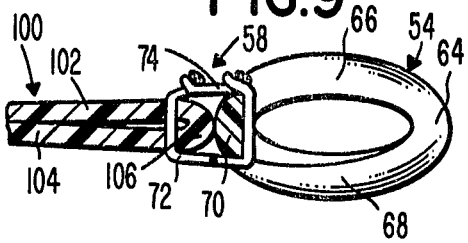
FIG. 9 is a cross section view similar to FIGS. 3 and 7 of a modification of the slide fastener stringer.
Figure 40:
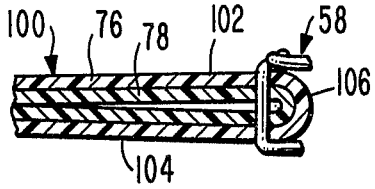
FIG. 40 is a cross section view of a variation of a folded tape in a slide fastener stringer of FIG. 9.
Figure 41:
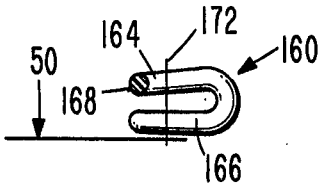
FIG. 41 is a diagrammatical cross section view of a fourth variation of the stringer with meander ladder coupling element of FIGS. 26 and 27.
Figure 42:
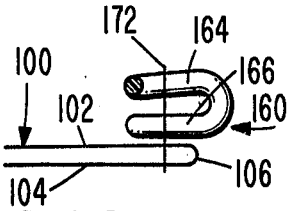
FIG. 42 is a diagrammatical cross section view of a fifth variation of the stringer portion of FIGS. 26 and 27.

The modification shown in FIG. 9 includes a folded tape indicated generally at 100 in place of the laminated tape 50 of the slider fastener stringer shown in FIG. 3. The folded tape 100 is formed of either a film strip having a single layer of highly oriented synthetic polymer resin as shown in FIG. 9 or a film strip having two laminated layers 76 and 78 of highly oriented synthetic polymer as shown in FIG. 40; tapes having more than two laminated layers can also be used. Both versions of the tape 100 have folded halves or portions 102 and 104 which are folded together about the inner edge or fold line 106. The thread 72 of the stitching 58 passes through the halves 102 and 104 adjacent to the folded edge 106 which abuts the heel portions 70 of the coupling element 54. In the version of the tape 100 with the single layer shown in FIGS. 9, 10, and 11, the molecular orientation of the unfolded tape extends along lines 108 at an oblique angle relative to the longitudinal dimension of the tape 100, and when the tape 100 is folded, the molecular orientation extends along lines 110 in the top 102, over the folded edge, and along lines 112 in the bottom half 104. The lines 110 and 112 are transverse to each other. Thus a stitch through both the superimposed layers formed by the folded portions 102 and 104 at points 114 and 116 in the respective folded portions 102 and 104 of the single layer version tends to tear in the directions of the respective arrows 118 and 120 which are transverse to each other in the folded tape; since the tape does not readily tear in a direction transverse to the molecular orientation, the thread passing through the folded tape at the superimposed points 114 and 116 is firmly held against tearing. In the double layer version of FIG. 40, the molecular orientations of the layers 76 and 78 are the same as for the tape 50 in FIG. 5, i.e. transverse to each other and oblique to the inner or folded edge of the tape. Thus four layers are superimposed with molecular orientations which cross the orientations of the immediate adjacent layers to provide even stronger resistance to splitting and tearing from the forces on the attaching threads. Further it is noted that the folded halves 102 and 104 can not shift relative to each other longitudinally along the tape near the folded edge; and the folded edge results in a continuous highly oriented portion which is tear resistant passing between points 114 and 116 in the folded tape 100.

Figure 13:
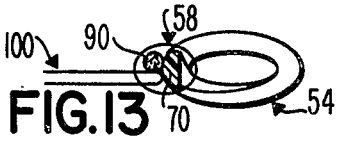
FIG. 13 is diagrammatical cross section view of a second variation of the modified stringer portion of FIG. 9.
Figure 14:
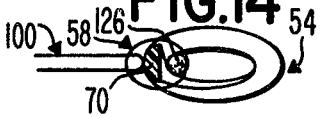
FIG. 14 is a diagrammatical cross section view of a third variation of the modified stringer portion of FIG. 9.
Figure 15:
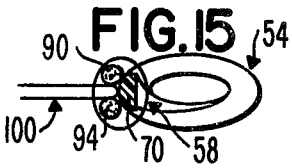
FIG. 15 is a diagrammatical cross section view of a fourth variation of the modified stringer portion of FIG. 9.
Figure 16:
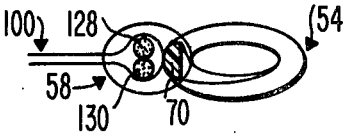
FIG. 16 is a diagrammatical cross section view of a fifth variation of the modified stringer portion of FIG. 9.
Figure 17:
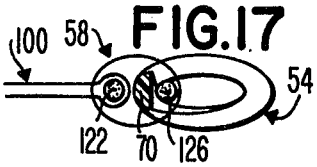
FIG. 17 is a diagrammatical cross section view of a sixth variation of the modified stringer portion of FIG. 9.
Figure 18:
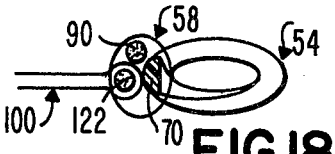
FIG. 18 is a diagrammatical cross section view of a seventh variation of the modified stringer portion of FIG. 9.
Figure 19:
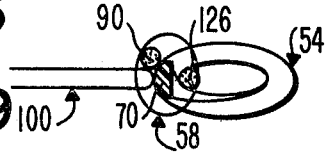
FIG. 19 is a diagrammatical cross section view of an eighth variation of the modified stringer portion of FIG. 9.
Figure 20:
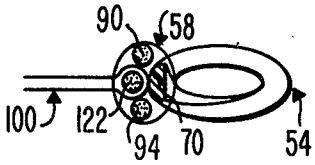
FIG. 20 is a diagrammatical cross section view of a ninth variation of the slide fastener stringer portion of FIG. 9.

In variations of the slide fastener with folded tapes as illustrated in FIGS. 12–20, longitudinal members or cords are secured by the overedge stitching 58 in various arrangements engaging the heels of the coupling elements, within the folded edges of the tapes, and/or within the spiral coupling elements. A longitudinal internal cord or filament 122 secured within the folded edge of the tape by the stitching 58 is shown in FIGS. 12, 17, 18 and 20, while two longitudinal internal cords 128 and 130 lying in a plane perpendicular to the planar portion of the tape 100 within the folded edge of the tape are shown in FIG. 16; these internal cord or cords within the folded edge form a bead on the folded edge of the tape for better support of the coupling element 54 as well as distributing stress from the stitches throughout the folded edge and thus reinforcing the securement of the coupling element on the edge of the tape 100. The longitudinal external cord 90 secured against the heels 70 of the coupling element 54 by the overedge stitching 58 similar to the variation of FIG. 7 can also be included on the top of the folded edge of the tape 100 as shown in FIG. 13. In FIG. 15 the upper external cord 90 is combined with the lower external cord 94 similar to the variation of FIG. 8; in FIG. 18 the upper external cord 90 is combined with the internal cord 122; and in FIG. 20 the upper external cord 90 is combined with both the lower external cord 90 and the internal cord 122. A cord or filament 126, FIG. 14, located within the spiral coupling element 54 is shown surrounded by the overedge stitching 158 together with the heel portions 70 and the folded edge of the tape 100 to increase the stability of the coupling element. This cord 126 internal the spiral coupling element 54 can also be combined with the other external and internal cords, such as in FIG. 17 with the internal cord 122 in the folded edge of the tape 100 and in FIG. 19 with the external cord 90 against the outside surfaces of the heel portions of the coupling element 54.

Figure 21:
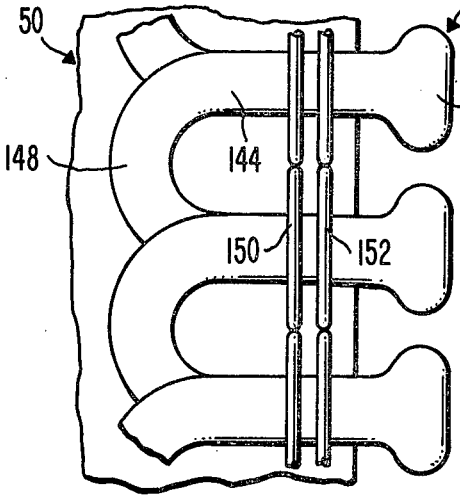
FIG. 21 is a enlarged plan view of a portion of a stringer of another modification of the slide fastener with a round coil ladder coupling element.
Figure 22:
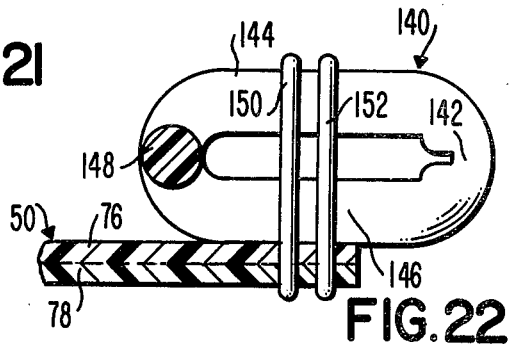
FIG. 22 is a cross section view of the stringer portion of FIG. 21.

As shown in FIGS. 21 and 22 another modification of the slide fastener includes a round coil ladder-type of coupling element indicated generally at 140 which has a head portion 142, an upper leg portion 144, a lower leg portion 146, and a heel or interconnecting portion 148 connecting to an adjacent section of the coupling element. The round coil ladder-type coupling element 140 is formed from a filament of generally circular cross section into a coil with the head portions 142 of the filament being deformed in cross section. The coupling element 140 is attached to the inner edge of the tape 50 by a pair of rows of stitches 150 and 152 passing through the tape 50 and over the leg portions 144 and 146. Similar to the slide fastener stringer of FIG. 3, the tape 50 has the two laminated plies 76 and 78 of crossing molecular orientation providing a substantially tear resistant tape 50 on which the coupling element 140 is mounted by the stitches 150 and 152; thus a strong fastener is produced with relatively inexpensive material used for the carrier tape.

Figure 23:
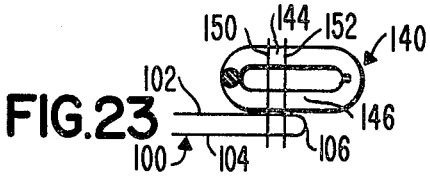
FIG. 23 is a diagrammatical cross section view of a variation of the modified stringer portion of FIGS. 21 and 22.
Figure 24:
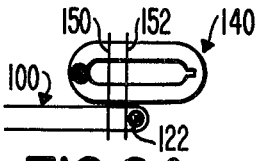
FIG. 24 is a diagrammatical cross section view of a second variation of the modified stringer portion of FIGS. 21 and 22.
Figure 25:
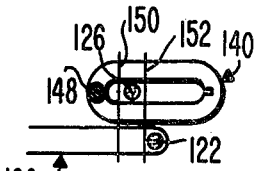
FIG. 25 is a diagrammatical cross section view of a third variation of the modified stringer portion of FIGS. 21 and 22.

Variations of the slide fastener with the rounded coil ladder-type coupling element 140 are shown in FIGS. 23, 24 and 25 wherein the folded tape 100 with one or more layers of film with oblique molecular orientation is employed instead of the tape 50. In FIG. 24 the cord 122 within the folded edge of the tape 100 is included to further increase the strength of attachment of the stitches 150 and 152 against tearing from the folded edge of the tape 100. In FIG. 25 the cord 126 is included in the coil coupling element 140 with the stitches 150 and 152 on opposite sides thereof to provide increased stability of the coupling element 140; also in this variation the cord 122 is inserted in the fold of the tape 100.

As shown in FIGS. 26 and 27, the slide fastener can be modified to include meander ladder-type coupling elements indicated generally at 160. The meander coupling element 160 is formed from a continuous filament of generally circular cross section with head portions 162 formed by deforming the cross section of the filament and with leg portions 164 and 166 extending on opposite sides of the folded tape 100 over the folded edge 106 with an upper heel or connecting portion 168 connecting pairs of the upper leg portions 164 together and lower connecting or heel portions 170 connecting pairs of the lower leg portions 166 together. A line of stitches 172 has thread means passing through the tape 100 near its folded edge 106 and over the leg portions 164 and 166 to secure the coupling element 160 to the inner edge of the tape 100. The cross molecular orientations of the folded halves 102 and 104 and of the layers 76 and 78, when employed as shown in FIG. 27, of the folded tape 100 provide increased strength in the attachment of the coupling element 160 to the tape 100.

Variations of the slide fastener with meander ladder-type coupling elements, are illustrated in FIGS. 28, 29, 30, and 31. The laminated tape 50 is substituted in FIG. 28 for the folded tape 100; the cross molecular orientations of the layers 76 and 78 resulting in increased strength for holding the stitches 172. In the variations of FIGS. 29 and 31 the cord 122 is inserted in the folded edge of the tape 100 to reinforce the folded edge and provide a stronger support for the stitches 172. Further in the variation of FIGS. 30 and 31 the overedge stitch 58 is used in place of the straight line stitch 172; the overedge stitch having the threads 72 passing through the tape 100 and around the heel portions 168 and 170 as well as around the folded edge of the tape 100.

In a still further modification illustrated in FIGS. 32 and 33 a continuous coupling element in the form of a molded train indicated generally at 180 is employed. The individual coupling elements 180 are molded in spaced relationship on parallel filaments or connecting threads 188, 190, 192 and 194. Each of the molded coupling elements 180 includes a head portion 182, an upper leg portion 184 and a lower leg portion 186. The upper leg portions 184 are molded around the connecting threads 188 and 190 adjacent the heels thereof while the leg portion 186 are molded around the connecting threads 192 and 194 adjacent the heels thereof. The molded train of coupling elements is attached to the edge of the tape 50 by the line of stitching 172 which includes thread means passing through the tape 50 and over the leg portions 184 and 186 between the connecting threads 188 and 190 and between the connecting threads 192 and 194. Again the cross molecular orientation of the plies 76 and 78 of the tape 50 provides a relatively strong stringer formed with this type of fastening element mounted by the stitching on the polymer film tape.

Variations of the slide fastener with the molded coupling element train 180, as shown in FIGS. 34, 35, 36 and 37, have the folded tape 100 with one or more laminated layers (only one layer shown) substituted for the laminated tape 50. The folded edge 106 of the tape 100 is positioned between the leg portions 184 and 186 with the stitch means passing therethrough. In the variations of FIGS. 35 and 37 the cord 122 is included within the folded edge 106 of the tape 100 while in the variation of FIGS. 36 and 37 the overedge stitch 58 is employed instead of the straight line of stitches 172.

Figure 10:
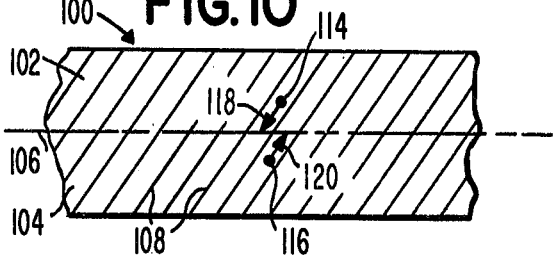
FIG. 10 is a plan view of a strip in an unfolded condition for forming the support member of the stringer portion shown in FIG. 9.
Figure 11:
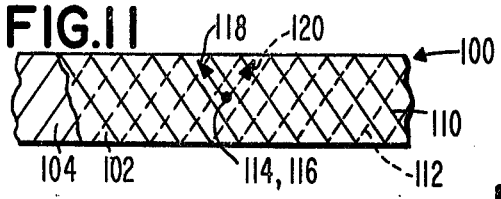
FIG. 11 is a plan view of the strip of FIG. 10 in a folded condition.
Figure 12:
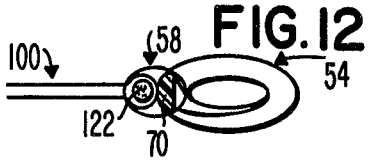
FIG. 12 is diagrammatical cross section view of a first variation of the modified stringer portion of FIG. 9.

There is shown in FIG. 38 a polymer film tape 200 either with a single film layer having a molecular orientation at an oblique angle to the longitudinal dimension similar to the film shown in FIGS. 9–11, or with two or more film layers laminated together having molecular orientations transverse to each other and oblique to the longitudinal dimension similar the film of FIG. 40. The tape 200 has an upper portion 202 extending the full width of the tape 200 but has a lower portion 204 extending substantially less than the full width of the tape 200. The width of the portion 204 is selected to be sufficient for attachment of the stitching 58 through the superimposed portions 202 and 204 with crossing molecular orientation to provide a strong base for the stitching 58.

In yet another modification illustrated in FIG. 39, a folded non-woven polymer tape 210 has an upper portion 212 and a lower portion 214 which are folded together about a fold line 216 wherein sections 218 and 220 of the respective upper and lower portions 212 and 214 adjacent the fold line 216 are formed with a substantially greater thickness. This greater thickness through which the stitching 58 passes provides a substantially stronger support for the stitching thread. Additionally the tape 210 can be made with a molecular orientation which is at an oblique angle to the longitudinal dimension of the tape to provide additional strength for the stitching attaching the coupling element 54 to the tape.

Figure 43:
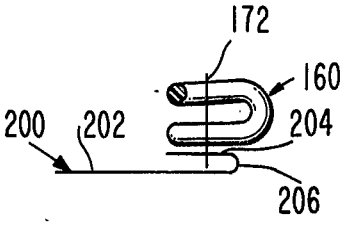
FIG. 43 is a diagrammatical cross section view of a sixth variation of the stringer portion of FIGS. 26 and 27.
Figure 44:
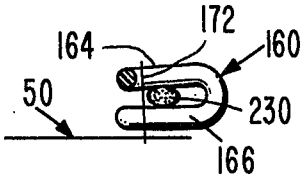
FIG. 44 is a diagrammatical cross section view of a seventh variation of the stringer portion of FIGS. 26 and 27.
Figure 45:
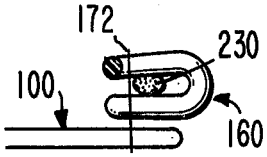
FIG. 45 is a diagrammatical cross section view of an eighth variation of the stringer portion of FIGS. 26 and 27.
Figure 46:
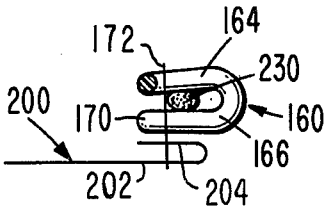
FIG. 46 is a diagrammatical cross section view of a nineth variation of the stringer portion of FIGS. 26 and 27.
Figure 47:
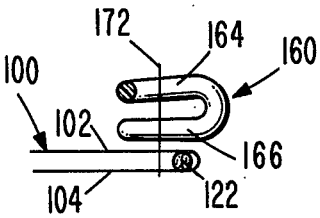
FIG. 47 is a diagrammatical cross section view of a tenth variation of the stringer portion of FIGS. 26 and 27.
Figure 48:
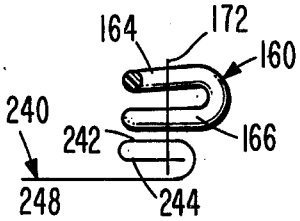
FIG. 48 is a diagrammatical cross section view of an eleventh variation of the stringer portion of FIGS. 26 and 27.
Figure 49:
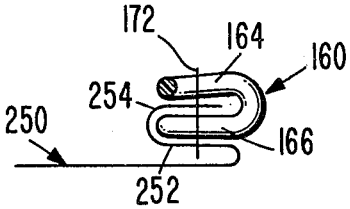
FIG. 49 is a diagrammatical cross section view of a twelfth variation of the stringer portion of FIGS. 26 and 27.
Figure 50:
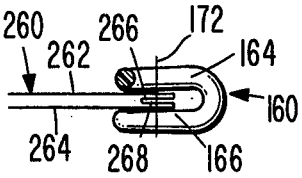
FIG. 50 is a diagrammatical cross section view of a thirteenth variation of the stringer portion of FIGS. 26 and 27.
Figure 51:
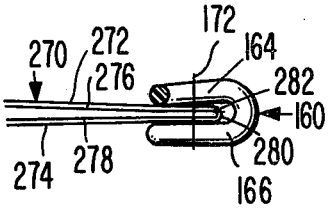
FIG. 51 is a diagrammatical cross section view of a fourteenth variation of the stringer portion of FIGS. 26 and 27.
Figure 52:
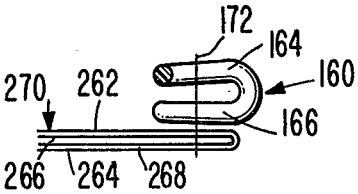
FIG. 52 is a diagrammatical cross section view of a fifteenth variation of the stringer portion of FIGS. 26 and 27.

Still further variations of the slide fastener employing the meander-type coupling element 160 are illustrated in FIGS. 41–52. In the variations of FIGS. 41–47, the leg portions 164 and 166 of the coupling elements 160 are secured by the stitching 172 together on only one side of the tape 50 (FIGS. 41 and 44), the tape 100 (FIGS. 42, 45 and 47) or the tape 200 (FIGS. 43 and 46). A longitudinal cord 230 is shown secured by the stitching 172 between the leg portions 164 and 166 in FIGS. 44, 45 and 46; this cord 230 holds the leg portions 164 and 166 apart and increases the longitudinal stability of the coupling element 160. In FIG. 47 the cord 122 in the folded edge of the tape 100 is included to increase the resistance of the tape 100 against tearing from the crosswise force of the slide fastener applied to the stitching 172. In the tape 200 when a double layer laminated film such as in FIG. 40 is employed, the stitching 172 may pass only through the upper narrow portion 204 as shown in FIG. 43; however the stitching can pass through both portions 202 and 204 as shown in FIG. 46 and must pass through both portions when the tape 200 is formed from a single layer of highly oriented film. FIG. 48 illustrates the attachment of the coupling element 160 to a tape 240 which has a double fold formed from narrow folded portions 242 and 244. The stitching 172 passes through the narrow folded portions 242 and 244 as well as through the lower wide portion 248 to secure the legs 164 and 160 on the upper side of the tape 240; the tape 240 is formed from a polymer film strip having one or more layers of highly oriented polymer similar to that of FIGS. 9 or 40. Alternately, the stitching in FIG. 48 could be secured only through folded portions 242 and 244 thus having the stitching 172 covered by the bottom portion 248. A variation in FIG. 49 shows a tape 250 having two or more laminated layers of highly oriented polymer film similar to FIGS. 3 and 40 wherein an intermediate folded back portion 252 extends underneath both leg portions 164 and 166 and an end portions 254 is folded over the lower heel portions 170 and extends between the leg portions 164 and 166; the stitching 172 is secured in both portions 252 and 254. A tape 260 in FIG. 50 of one or more layers of polymer film with crossing oblique molecular orientations has an upper folded half 262 and a lower folded half 264. The inner folded edge of the tape 260 has portions 266 and 268 folded back within the upper and lower folded halves to thus form four superimposed portions 262, 264, 266 and 268 through which the stitching 172 is secured. Other versions with four superimposed portions are shown in FIGS. 51 and 52 wherein a tape 270 is formed from two film strips folded together to form folded halves 272 and 274, 276 and 278, respectively, through which the stitching 172 is secured; each of the two strips is formed from one or more laminated layers of polymer which has a high degree of molecular orientation in a direction oblique to the longitudinal dimension of the tape 270, so as to produce crossing orientations in superimposed layers of the film. In FIG. 51 the longitudinal inner folded edges 280 and 282 of the respective strips in the tape 270 are positioned between the legs 164 and 166, while in FIG. 52 the inner edge of the tape 270 is positioned beneath both legs 164 and 166.

Figure 53:
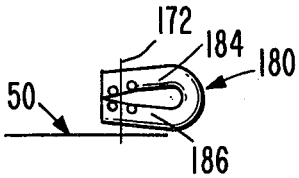
FIG. 53 is a diagrammatical cross section view of a fifth variation of the stringer with molded coupling elements of FIGS. 32 and 33.
Figure 54:
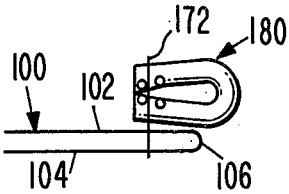
FIG. 54 is a diagrammatical cross section view of a sixth variation of the stringer portion of FIGS. 32 and 33.

Also additional variations of the slide fastener with the molded coupling element train 180 are shown in FIGS. 53 and 54. In these additional variations the leg portions 184 and 186 are secured together by the stitches 172 to only one side of the tape 50, FIG. 53, or the tape 100, FIG. 54.

Since the present invention is subject to many modifications, variations, and changes in detail, it is intended that all matter in the foregoing description or shown in the accompanying drawings be interpreted as illustrative and not in a limiting sense.

What is claimed is

1. A stringer for a slide fastener comprising a continuous coupling element having a plurality of head portions for interlocking with head portions of a mating coupling element, a carrier tape, stitching means securing the continuous coupling element to one edge of the carrier tape, said tape including a pair of superimposed portions through which the stitching means passes, each of said pair of superimposed portions being a highly oriented polymer film, and the polymer orientations of said pair of superimposed portions being transverse to each other.

2. A stringer for a slide fastener as claimed in claim 1 wherein the polymer orientation of both superimposed portions are at oblique angles to the longitudinal dimension of the tape.

3. A stringer for a slide fastener as claimed in claim 1 wherein the pair of superimposed portions of the carrier tape are layers of oriented polymer which are laminated together.

4. A stringer for a slide fastener as claimed in claim 1 wherein the carrier tape is a longitudinally folded strip with a polymer orientation which is oblique to the longitudinal dimension of the strip, and the pair of superimposed portions are the respective folded together portions of the strip.

5. A stringer for a slide fastener as claimed in claim 4 wherein each folded portion includes at least two layers of oriented polymer laminated together with the orientations of the layers being transverse to each other oblique to the longitudinal dimension of the strip.

6. A stringer for a slide fastener as claimed in claim 4 wherein the stitching means is attached to the folded edge of the strip.

7. A stringer for a slide fastener as claimed in claim 1 including cord means secured by the stitching means on the one edge of the carrier tape adjacent to the coupling element.

8. A stringer for a slide fastener as claimed in claim 6 including cord means extending within the folded edge of the carrier tape and secured therein by the stitching means.

9. A stringer for a slide fastener as claimed in claim 8 wherein the cord means includes a pair of cords lying in a plane perpendicular to the tape.

10. A stringer for a slide fastener as claimed in claim 7 wherein the cord means includes a pair of cords on respective opposite sides of the one edge of the tape and secured thereto by the stitching means.

11. A stringer for a slide fastener as claimed in claim 6 including external cord means secured by the stitching means on the folded edge of the tape adjacent the coupling element.

12. A stringer for a slide fastener as claimed in claim 1 wherein the coupling element is a spiral coupling element formed from a continuous filament having an oblong cross section wherein the filament is twisted in each convolution to form a head portion, a pair of leg portions extending from opposite sides of the head portion and a heel portion connecting one of the pair of leg portions to a leg portion of an adjoining section of the spiral; and wherein the stitching means includes an overedge stitch passing around the one edge of the carrier tape and the heel portions of the spiral coupling elements.

13. A stringer for a slide fastener as claimed in claim 12 including external cord means secured on the one edge of the tape by the overedge stitch in abutment with the heel portions of the coupling element.

14. A stringer for a slide fastener as claimed in claim 12 wherein the tape is a strip folded longitudinally and the stitching means passes through the opposite folded portions of the strip, the folded edge of the strip being the one edge of the carrier tape.

15. A stringer for a slide fastener as claimed in claim 14 including internal cord means in the folded edge of the strip and secured by the overedge stitch.

16. A stringer for a slide fastener as claimed in claim 12 including cord means within the spiral coupling element, and wherein the overedge stitch includes thread means passing around the cord means.

17. A stringer for a slide fastener as claimed in claim 1 wherein the continuous coupling element is a round coil ladder-type coupling element formed form a continuous filament with head portions formed by deforming the cross section of the filament.

18. A stringer for a slide fastener as claimed in claim 17 wherein the carrier tape is a folded strip with the folded edge being the one edge of the tape and the stitching means passes through the folded portions of the tape.

19. A stringer for a slide fastener as claimed in claim 18 including internal core means within the folded edge of the tape and secured therein by the stitching means.

20. A stringer for a slide fastener as claimed in claim 17 including cord means extending within the round coil element and secured therein by the stitching means.

21. A stringer for a slide fastener as claimed in claim 20 wherein the stitching means includes a pair of straight lines of stitches which are on opposite sides of the cord means.

22. A stringer for a slide fastener as claimed in claim 1 wherein the continuous coupling element is a meander ladder-type coupling element formed from a continuous filament wherein the filament is bent into a meander pattern and the head portions are formed by deforming the cross section of the filament.

23. A stringer for a slide fastener as claimed in claim 22 wherein the one edge of the carrier tape extends between leg portions of each convolution of the meander pattern.

24. A stringer for a slide fastener as claimed in claim 22 wherein the meander ladder-type coupling element has a pair of leg portions extending from opposite sides of each head portion, the leg portions extend only on one side of tape, and the stitching means passes around each pair of leg portions.

25. A stringer for a slide fastener as claimed in claim 22 wherein the carrier tape is a strip which is folded and the one edge of the carrier tape is the folded edge of the strip.

26. A stringer for a slide fastener as claimed in claim 25 including cord means extending within the folded edge of the strip.

27. A stringer for a slide fastener as claimed in claim 25 wherein the strip has two laminated layers with a molecular orientation transverse to each other and oblique to the one edge of the tape.

28. A stringer for a slide fastener as claimed in claim 27 wherein the folded edge extends between leg portions of each convolution of the meander coupling element.

29. A stringer for a slide fastener as claimed in claim 22 including at least four superimposed tape portions through which the stitching means is secured.

30. A stringer for a slide fastener as claimed in claim 22 wherein one portion of the tape is positioned on one side of the leg portions and a second portion of the tape extends between the leg portions, and the stitching means passes through the one and second portions of the tape.

31. A stringer for a slide fastener as claimed in claim 22 wherein the stitching means includes an overedge stitch extending over the one edge of the tape.

32. A stringer for a slide fastener as claimed in claim 1 wherein the continuous coupling element includes a plurality of parallel connecting threads and a plurality of molded elements molded on the connecting threads.

33. A stringer for a slide fastener as claimed in claim 32 wherein the molded train of coupling elements each have a head portion and separate leg portions which extend parallel from the head portion, and the carrier tape has its one edge extending between the pair of leg portions.

34. A stringer for a slide fastener as claimed in claim 32 wherein the molded train of coupling elements each have a head portion and separate leg portions which extend parallel from a head portion, and the leg portions extend together on only one side of the one edge of the carrier tape.

35. A stringer for a slide fastener as claimed in claim 32 wherein the carrier tape is a folded strip and the one edge of the tape is the folded edge of the strip.

36. A stringer for a slide fastener as claimed in claim 35 including cord means extending within the folded edge of the strip.

37. A stringer for a slide fastener as claimed in claim 32 wherein the stitching means is an overedge stitch including thread means extending around the one edge of the tape and the connecting threads.

38. A stringer for a slide fastener as claimed in claim 6 wherein one folded portion of the strip has a width that is substantially less than the width of the other folded portion of the strip.

39. A stringer for a slide fastener comprising a continuous coupling element having a plurality of head portions for interlocking with head portions of a mating coupling element, a carrier tape formed from a longitudinally folded strip of polymer, said strip being formed from a highly oriented polymer which in oriented at an oblique angle to the longitudinal dimension of the tape, stitch means securing the continuous coupling element to the folded edge of the carrier tape, and said tape including a portion adjacent said folded edge which is substantially thicker than the remaining portion of the tape and through which the stitching means passes.

40. A stringer for a slide fastener as claimed in claim 39 wherein the stitch means is an overedge stitch passing around the folded edge of the carrier tape.

* * * * *